US005138308A

United States Patent [19]

Clerc et al.

[11] Patent Number: 5,138,308

[45] Date of Patent: Aug. 11, 1992

[54] MICROTIP FLUORESCENT MATRIX SCREEN ADDRESSING PROCESS

[75] Inventors: Jean-Frédéric Clerc, Machida, Japan; Anne Ghis, St. Martin d'Heres, France

[73] Assignee: Commissariat a l'Energie Atomique, Paris, France

[21] Appl. No.: 359,335

[22] Filed: May 31, 1989

[30] Foreign Application Priority Data

Jun. 1, 1988 [FR] France ..... 88 07288

[51] Int. Cl.[5] ..... G09G 3/04; G09G 3/30

[52] U.S. Cl. ..... 340/758; 340/781

[58] Field of Search ..... 340/758, 771, 773, 774, 340/787, 760, 781; 315/169.3; 358/241

[56] References Cited

U.S. PATENT DOCUMENTS 4,225,807 9/1980 Ise et al. ..... 340/781
4,542,379 9/1985 Satou ..... 340/758
4,707,692 11/1987 Higgins et al. ..... 340/781

FOREIGN PATENT DOCUMENTS 0155895 9/1985 European Pat. Off. .
0201609 11/1986 European Pat. Off. .
2536889 6/1984 France .

OTHER PUBLICATIONS

Electronics, vo. 59, No. 24, Jun. 16, 1986, pp. 18 and 19.

*Primary Examiner*—Ulysses Weldon
*Assistant Examiner*—M. Fatahiyar
*Attorney, Agent, or Firm*—Michael N. Meller

[57] ABSTRACT

A process for regulating the brightness of a microdot fluorescent screen and apparatus for performing this process. The screen is of the matrix type and is addressed by a scan of the rows, a pixel being formed at each row-column intersection. For an illuminated pixel, for a selection time T of the corresponding row, a quantity of charges is emitted by the associated microdots. The brightness is regulated during the selection time of each row by controlling the quantity of charges emitted by the microdots of each pixel to be illuminated, the charge quantity being identical for each pixel.

5 Claims, 3 Drawing Sheets

MICROTIP FLUORESCENT MATRIX SCREEN ADDRESSING PROCESS

The present invention relates to a process for addressing a microtip fluorescent screen and to an apparatus for performing this process. The invention also applies to the realization of displays making it possible to display fixed or moving pictures.

Microtip fluorescent screens are known and are more particularly described in the report of the International Congress "Japan Display 86", p 512. The main known features will now be described.

Such a screen, diagrammatically shown in perspective in FIG. 1, has a vacuum cell with a transparent or non-transparent lower support 1, on which are arranged conductive columns 3 (cathode conductors) supporting metallic microtips 6. The columns intersect perforated conductor rows 4 (grids). All the microtips positioned at an intersection of a row and a column essentially have their apex facing a perforation of the row. The rows and columns are separated by an insulating layer 5, e.g. of silica, which is provided with openings permitting the passage of the microtips. A fluorescent material layer 7 faces the grids. This layer is deposited on a transparent conductive layer 8 (anode), which rests on a transparent upper support 2.

For example, the fluorescent material is (zinc sulfide) and the supports are e.g. of glass. Each intersection of a grid and a cathode conductor corresponds to a pixel. For appropriate potentials applied to a grid and to a cathode conductor, the microtips (there can be several thousand of these) placed at the intersection of the grid and the cathode conductor emit electrons, which excite the fluorescent material when a potential equal to or higher than the potential applied to the grid is applied to the anode.

FIG. 2 shows a typical evolution of the current I corresponding to the electron flux passing through the anode as a function of the potential difference between the cathode conductor and the grid Vgc. This example is given for a microtip density of $10^4$ $mm^{-2}$ and the diameter 1.4 micron grid perforations. For a potential difference below e.g. Vgc=Vmin=40V, the emission is substantially zero and the screen has a negligible brightness. Below this limit value Vmin, emission increases in a non-linear manner so that, e.g. at Vgc=Vop=80V, it reaches 1mA/$mm^2$, which is adequate for obtaining a high screen brightness.

The parasitic brightness obtained for potential differences Vgc≦40 volt is a function of the number of rows of the screen. This parasitic brightness is negligible for video screens.

The value of the current emitted for a given voltage Vgc, for an isolated microtip, is dependent on the geometry, i.e. the distance between the grid and the dot, the metal of the dot, the extraction energy of the electrons being dependent on said metal, the profile of the dot and its surface state.

Existing screens have several thousand microtips per pixel. This makes it possible to average out the emission variations dot by dot. However, large inhomogeneities in the values of these parameters lead to screen brightness fluctuations.

For such a screen, the display is in matrix form. The rows are formed by grids and the columns by cathode conductors. The rows are sequentially raised to a potential Vg>O for a selection time T and the columns are raised to a potential corresponding to the information to be displayed. The following table 1 gives an example of the potentials applied to the rows and columns and the states of the pixels corresponding to the intersections of said rows and said columns, the anode being raised to a potential higher than or equal to Vg. The values given here correspond to the characteristics of the screen referred to hereinbefore.

TABLE 1

| Rows | Columns | Pixels |
|---|---|---|
| Vg = 40 V (selected line) | Vc = 0 V | (Vg − Vc = 40 V) extinguished |
| | Vc = −40 V | (Vg − Vc = 80 V) illuminated |
| Vg = 0 V (non-selected line) | Vc = 0 V | (Vg − Vc = 0) extinguished |
| | Vc = −40 V | (Vg − Vc = 40 V) extinguished |

This example will be explained as follows. The emission of electrons by the microtips is essentially dependent on the difference between the potential supplied to the grids and the cathode conductors. The potential applied to the anode is fixed once and for all.

For a non-selected row, the grid potential Vg is zero, whereas the cathode potential Vc for the considered column can either be equal to 0 V, or equal to −40 V. The potential difference Vgc=Vg−Vc is then equal to or below 40 V, i.e. equal to or below the emission threshold Vmin (FIG. 2).

For a selected row, the grid potential Vg is equal to 40 V. The cathode potential Vc for the considered column is either zero and in this case Vgc=40V, Vgc=Vmin and there is no electron emission, or equal to −40V and in this case Vgc=80V, Vgc=Vop and there is a high electron emission.

The emission of electrons by microtips essentially takes place during the time when, for a given grid-cathode conductor pair, the potential difference Vgc is approximately Vop.

However, it was stated hereinbefore that considerable inhomogeneities existed in the structure of the screen. FIG. 3 shows an example of the fluctuations of the current response passing through the anode, corresponding to the emission of electrons by the microtips, as a function of the potential difference Vgc. Two curves are shown for two separate pixels A and B of the screen and do not have the same characteristics. For the same potential difference Vop=80V, pixel A is very bright and pixel B is not very bright. This is the major disadvantage of such a microtip fluorescent screen, which is obviated by the present invention.

As a result of the present invention, the brightness of all the illuminated pixels of the screen is identical, despite screen structure inhomogeneities. For this purpose, the total quantity of charges emitted by the corresponding to the illuminated pixels is equalized.

More specifically, the present invention relates to a process for addressing a microtip fluorescent matrix screen for the display of a video image with the aid of pixels able to assume either the "illuminated", or the "extinguished" state and the uniformization to a randomly regulatable value of the brightness of the pixels in the "illuminated" state of said screen, said screen having a vacuum cell with a lower support on which are arranged, in the two directions of the matrix, conductor columns (cathode conductors) supporting metallic microdots and, above the columns, perforated conductor rows (grids), each intersection of a row i and a column j corresponding to a pixel, the apex of each microtip essentially facing a perforation of the row, the rows and columns being separated by an insulating layer having openings permitting the passage of microtips, a fluorescent material layer facing the grids, said layer being placed on a transparent conductive layer (anode), which rests on a transparent upper support, the display of a frame of the image or picture taking place by sequentially addressing each grid conductor row for a selection time T within which simultaneous addressing takes place by a data signal of all the pixels of the row during the addressing in order to "illuminate" those pixels of the said row which should be illuminated, characterized in that the addressing of a row i takes place by raising the corresponding grid conductor to a constant potential Vg during the selection time T, during the selection T of said row i and in this order:

all the cathode conductors (columns) corresponding to a pixel of said row i having to be illuminated are raised to a potential Vc, such that the potential difference Vg-Vc is adequate to "illuminate" the pixels, while ensuring a significant electron emission by the microtips, the cathode conductors are insulated and each of the elementary capacitors formed by the insulating layer, the grid and the cathode conductor of each "illuminated" pixel is allowed to freely discharge on its internal impedance until the spontaneous potential difference variation between its two cathode conductor and grid electrodes reaches, for each pixel, a level corresponding to the chosen brightness for all the "illuminated" pixels of the screen, at the time when, for each "illuminated" pixel, said condition is fulfilled, action again takes place on its cathode conductor potential Vc by raising it to a value bringing about the extinction of the pixel.

The invention also relates to an apparatus for performing the process comprising a control stage for each conductor, characterized in that each control stage comprises:

a circuit of the "three state" type having a first input E1 raised to a potential V1 by an external supply, a second input E2 raised to a potential V2 by an external supply, an output S supplying the potential Vc, Vc assuming in a recurrent manner a value dependent on the state of the circuit during the selection time T of a row, for a first fixed time t1 starting with the selection time T of each row, the circuit being in a state 1, Vc is raised to the potential V1 such that the difference Vg−V1 is adequate for "illuminating" the pixel, during a second time t2 dependent on each pixel, the circuit is in a high impedance state 2, Vc varying spontaneously and almost linearly from V1 to a potential Vd determined in such a way as to obtain the brightness chosen for the "illuminated" pixels, during a third time t3 corresponding to T−(t1+t2), the circuit is in a state 3, Vc is raised and maintained at potential V2 until the circuit returns to state 1, a shaping circuit supplying signals controlling passages from one state to another of the "three state" circuit, said signals being supplied on two outputs Sm1 and Sm2 respectively connected to two inputs Em1 and Em2 of the "three state" circuit, the shaping circuit also having an input E6 connected to the output of a supply common to all the control stages, supplying a periodic signal S1 of duration t1 and period T (selection time of a grid), a comparator circuit having an input E8 connected to the output S of the "three state" circuit, an input E9 connected to an output of a supply supplying a potential V3>Vd, an input E10 connected to an output of a supply (28) supplying a potential V4≦Vd, V4 being regulatable as a function of the chosen screen brightness, the comparator circuit supplying on an output Sc a control signal on an input E7 of the shaping circuit.

According to a preferred embodiment, the "three state" circuit comprises:

two transistors T1 and T2 of the field effect transistor type, which are interconnected by their drain, the output S of the "three state" circuit being connected to the drain-drain connection of the transistors T1 and T2, the source of transistor T1 being connected to input E1 and the source of transistor T2 being connected to the input E2; a conversion stage connected to the inputs E1, E2, Em1, Em2, to the gates of transistors T1 and T2 and to the two supplies respectively supplying the potentials A1 and A2, said stage ensuring the conversion of potentials A1 and A2 to potentials V2 and V2−Vs2 on the one hand and potentials A1 and A2 to potentials V1 and V1+Vs1 on the other, Vs1 and Vs2 being the threshold voltages of transistors T1 and T2.

According to a preferred embodiment, the comparator circuit comprises a resistive circuit connected to input E9 and connected to the drain of a field effect transistor T3, which is connected by its gate to input E8 and by its source to input E10, the drain-resistive circuit connection being connected to the input of a conversion stage, whose output is connected to output Sc, said conversion stage also being connected to two supplies respectively supplying potentials A1, A2, said conversion stage ensuring the translation of potentials V3 and V4 to potentials A2 and A1.

According to a preferred embodiment, the shaping circuit comprises a circuit fulfilling a "shift" function and a circuit fulfilling an "enable" function respectively supplying signals to the outputs Sm1 and Sm2.

The invention is described in greater detail hereinafter relative to non-limitative embodiments and the attached drawings, wherein:

FIG. 1, already described and relating to the prior art, shows diagrammatically and in perspective a microtip fluorescent screen.

FIG. 2, already described and relating to the prior art, show a typical current response curve corresponding to the emission flux of the microtips as a function of variations in the potential difference between the cathode conductor and the grid Vgc.

FIG. 3, already described and relating to the prior art, show an example of the current response corresponding to the electron emission flux of the microtips associated with two separate pixels as a function of variations of the potential difference between the cathode conductor and the grid Vgc.

Figure 4:
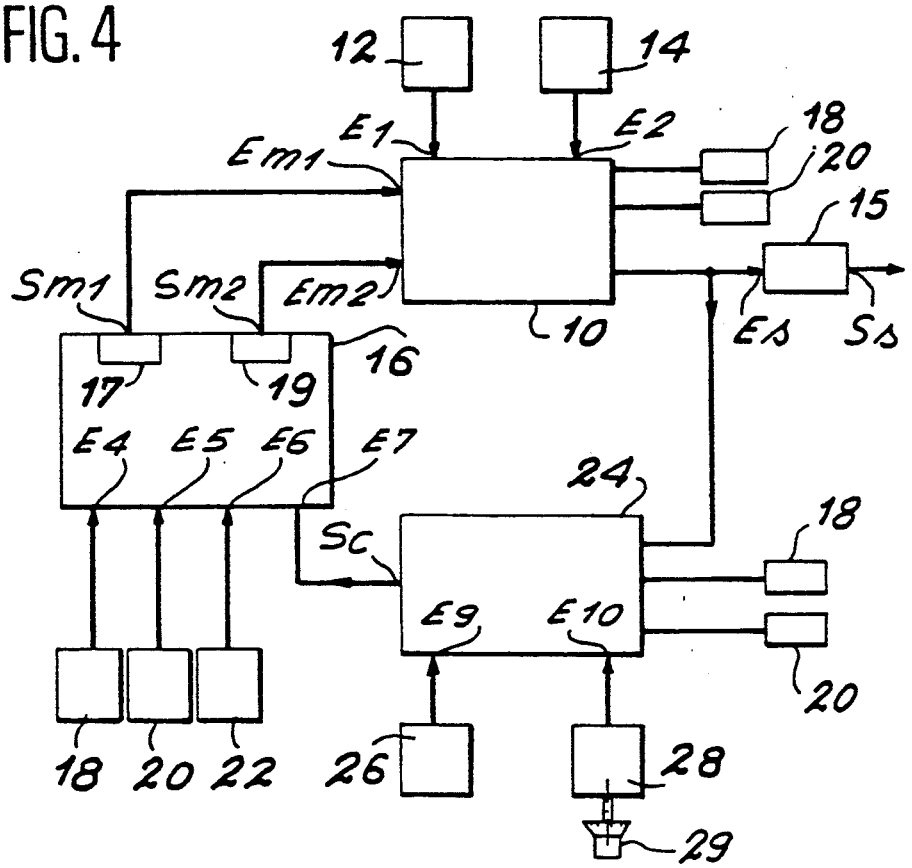
FIG. 4 is a general diagram of a control stage for a column (cathode conductor) according to the invention.
Figure 5:
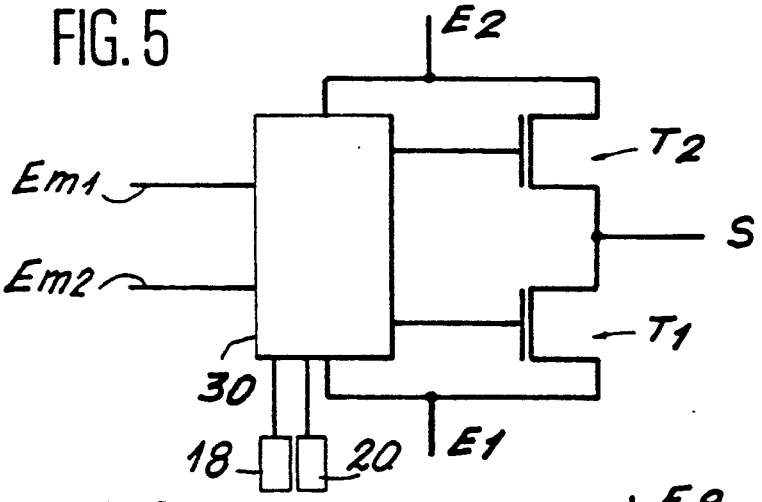
FIG. 5 shows an example of a "three state" circuit used in the control apparatus according to the invention.

FIG. 4 shows a control stage for a conductor column (not shown cathode conductor) in a diagrammatic manner. This control stage comprises a "three state" circuit 10, a shaping circuit 16 and a comparator circuit 24. It is also possible to see the different supplies 12, 14, 18, 20, 22, 26, 28 supplying the potentials used by circuits 10, 16, 24. These supplies are common to the control stages of all the columns. As can be seen in FIG. 5, the "three state" circuit 10 is e.g. constituted by two field effect transistors T1 and T2 and a conversion stage 30.

Transistors T1 and T2 are interconnected by their respective drains. Their junction is connected to an output S of the "three state" circuit 10. Output S supplies the control potential Vc of the cathode conductor allocated to the control stage.

The source of transistor T1 is connected to an input E1 of circuit 10. The source of transistor T2 is connected to an input E2 of circuit 10. The gates of transistors T1 and T2 are connected to the conversion stage 30, which is connected to the inputs E1 and E2 and to the inputs Em1 and Em2 of the "three state" circuit 10.

The conversion stage 30 converts the potentials A1 and A2 supplied by supplies 18, 20 to potentials V2 and V2−Vs2 on the one hand and to potentials V1 and V1+Vs1 on the other. A1 can be equal to 0 V and A2 to 5 V in accordance with one preferred embodiment. Vs1 and Vs2 are the threshold potentials of transistors T1 and T2.

Potential Vc assumes different values according to the state of circuit 10:

state 1: Vc varies from V2 to V1 (variation corresponding to the charge of the elementary capacitor formed by the insulating layer 5 between grid 4 and the cathode conductor via the resistance of a cathode conductor 3), state 2: Vc varies from V1 to Vd, circuit 10 being in the high impedance state, the cathode conductor connected thereto being isolated, the elementary capacitor discharging on its internal impedance in a quasi-linear manner, because the discharge time constant is then very great, when Vc reaches the value Vd circuit 10 passes to state 3, state 3: Vc is raised (by the discharge of the elementary capacitor on the resistance of the cathode conductor) from Vd to V2 and is kept at this value until the circuit 10 returns to state 1.

The potentials V1 and V2 respectively applied to the inputs E1 and E2 are supplied by supplies 12 and 14 respectively. The value of V1 can e.g. be −40 V and that of V2 e.g. 0 V.

The passages from state 3 to state 1 and from state 1 to state 2 are controlled via inputs Em1 and Em2 by the shaping circuit 16 from a signal S1 supplied to the input E6 of circuit 16 by the supply 22 common to all the control stages. Signal S1 is a square-wave voltage of duration t1 of period T (grid selection time). The leading edge of S1 corresponds to the passage from state 3 to state 1 and the trailing edge to the passage from state 1 to state 2.

Signal S1 is obtained in a conventional manner from a circuit realizing a row synchronisation clock function and a monostable circuit. The passage to state 3 is also controlled via inputs Em1, Em2 by the shaping circuit 16 from a suitable signal supplied on its input E7 by the output Sc of comparator circuit 24.

Thus, periodically the output S supplies at the grid selection time period T, the potential Vc permitting the "illumination" of the pixel corresponding to the intersection of the selected grid and the cathode conductor attached to the considered control stage. The "illumination" is validated by a switch 15 connected to output S by an input Es.

If the considered pixel has to be illuminated, then the switch 15 supplies the potential Vc to an output Ss connected to the cathode conductor connected to its pixel. If not, the switch 15 supplies the potential V2 e.g. to its output Ss and the pixel is "extinguished". Such a switch is provided conventionally in devices of this type.

The shaping circuit 16 has circuits 17 and 19 fulfilling "shift" and "enable" functions. An output Sm1, Sm2 is allocated to each function. Output Sm1 is connected to input Em1 of the "three state" circuit 10 and output Sm2 is connected to input Em2 of said circuit 10. The shaping circuit is supplied by potentials A1 and A2 supplied by supplies 18 and 20 respectively connected to inputs E4 and E5. For example, potential A1 is a zero potential and potential A2 is e.g. a potential of 5 V.

The following table 2 is the logic table of the shaping circuit performing the "shift" and "enable" functions at outputs Sm1 and Sm2 from potentials supplied to inputs E6 and E7.

TABLE 2

| E6 | E7 | Sml: "shift" function | Sm2: "enable" function |
|---|---|---|---|
| 0V | 0V | 0V | 0V |
| 5V | 0V | 5V | 0V |
| 0V | 5V | 0V | 5V |
| 5V | 5V | 5V | 0V |

The values 0 V and 5 V of the different potentials are only given for information purposes.

The following table 3 is the logic table of the "three state" circuit 10 associated with the shaping circuit. Table 3 gives the signal supplied at output S of circuit 10 from signals applied to the inputs Em1 and Em2.

TABLE 3

| Em1 | Em2 | S |
|---|---|---|
| 0V | 0V | V2 |
| 5V | 0V | V1 |
| 0V | 5V | high impedance |
| 5V | 5V | state |

In another embodiment, the shaping circuit controls the transistor T1 of the "three state" circuit, which has the same structure as the circuit shown in FIG. 5, by applying the signal S1 to the input Em1 and it controls the transistor T2 of the "three state" circuit by applying to input Em2 a signal from a logic combination of signal S1 and the signal supplied by the comparator circuit.

Tables 4 and 5 are respectively the logic tables of the associated shaping and "three state" circuits corresponding to this variant.

Table 4 gives the potentials supplied on outputs Sm1 and Sm2 of the shaping circuit from potentials supplied on inputs E6 and E7 thereof.

Table 5 gives the potentials supplied on output S of the "three state" circuit from potentials supplied by the shaping circuit on inputs Em1 and Em2.

TABLE 4

| E6 | E7 | Sm1 | Sm2 |
|---|---|---|---|
| 0V | 0V | 0V | 5V |
| 0V | 5V | 0V | 0V |
| 5V | 0V | 5V | 0V |

TABLE 4-continued

| E6 | E7 | Sm1 | Sm2 |
|---|---|---|---|
| 5V | 5V | 5V | 0V |

TABLE 5

| Em1 | Em2 | S |
|---|---|---|
| 0V | 0V | high impedance |
| 5V | 0V | V1 |
| 0V | 5V | V2 |
| 5V | 5V | V1 |

Figure 6:
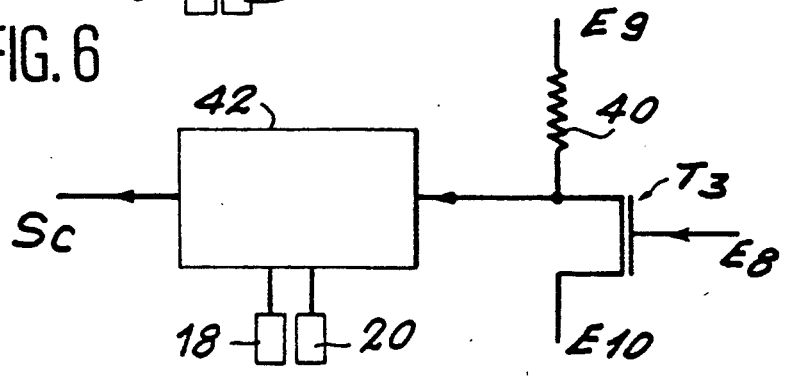
FIG. 6 shows an example of a comparator circuit used in the control apparatus according to the invention.
Figure 7A:
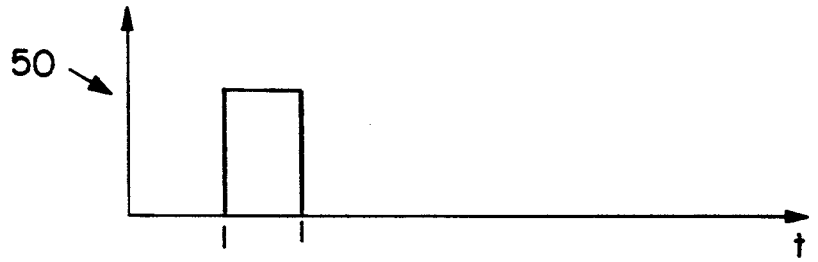
FIGS. 7A–7E shows an example of potential timing charts applied to the inputs E6 and E7 of the shaping circuit, to the outputs Sm1 and Sm2 corresponding to the "shift" and "enable" functions of the shaping circuit and to the output S of the "three state" circuit.
Figure 7B:
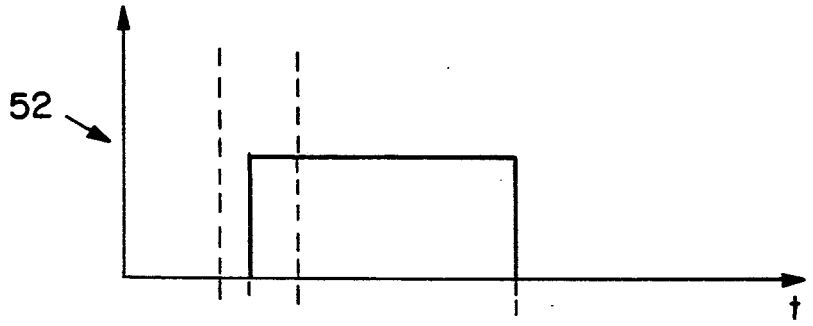
Figure 7C:
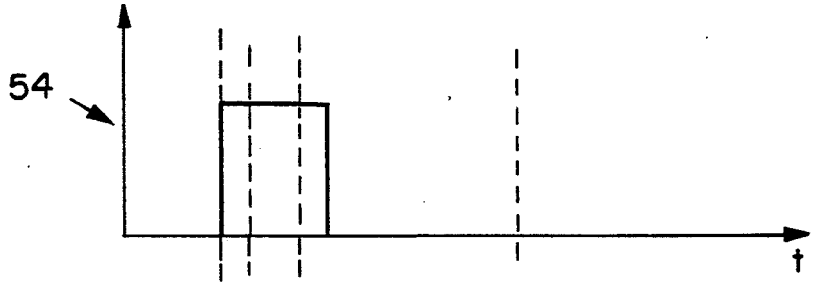
Figure 7D:
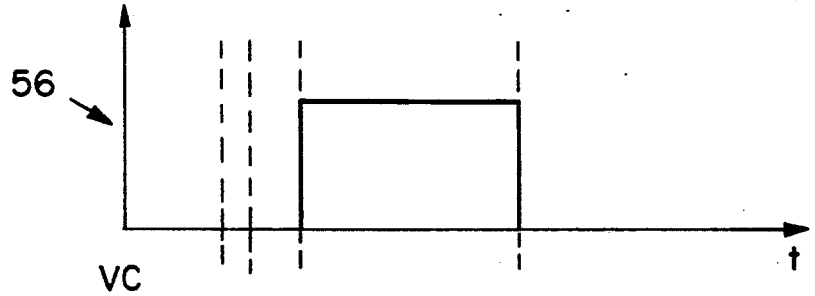
Figure 7E:
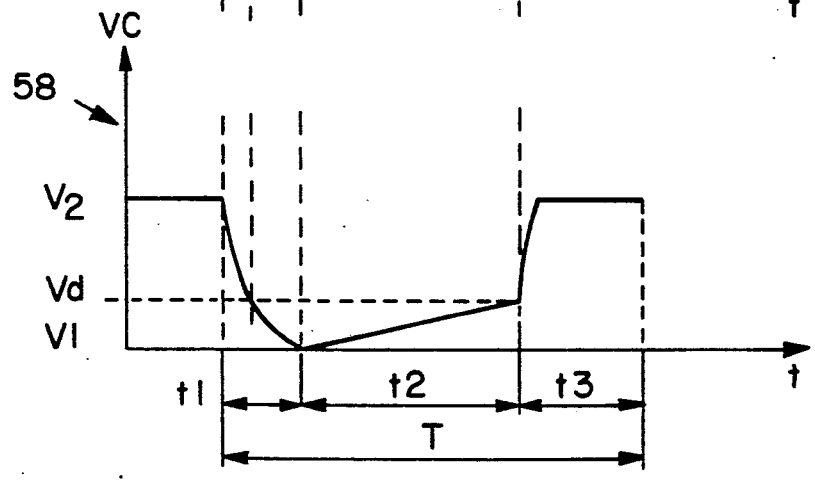

FIG. 6 is an embodiment of a comparator circuit, which is constituted by a resistive circuit 40, a field effect transistor T3 and a conversion stage 42. As a function of the value of the potential Vc applied to input E8 connected to the gate of transistor T3, the circuit will supply potentials A1 or A2 at its output Sc. The output potentials applied to Sc as a function of the value of the potential applied to input E8 are summarized in the following table 6:

TABLE 6

| Potential Vc applied to input E8 | Potential applied to output Sc |
|---|---|
| Vc > Vd | 0V |
| Vc < Vd | 5V |

The source of transistor T3 is connected to one input E10 of comparator circuit 24. Input E10 is raised to a potential V4=Vd−Vs3 via a supply 28. Vs3 is the threshold potential of transistor T3. Supply 28 makes it possible to vary the value of potential V4 by means of an external control 29. As potential Vs3 is fixed, the variations of V4 correspond to variations of Vd. By acting on the value of Vd, it is possible to obtain the desired screen brightness. The resistive circuit 40 is connected on the one hand to the drain of transistor T3 and on the other hand to an input E9 of the comparator circuit 24. Input E9 is raised to a potential V3 via a supply 26. The value of potential V3 is higher than Vd.

If the potential applied to input E8 is higher than (Vd−Vs3)+Vs3, then transistor T3 is conductive or on and the input of the conversion stage 42 is raised to potential V4=Vd−Vs3. If the potential applied to the input E8 is below (Vd−Vs3)+Vs3, then transistor T3 is non-conductive or off and the input of the conversion stage 42 is raised to potential V3.

The function of conversion stage 42 is to supply on output Sc a potential e.g. equal to A1=0 V, if its input is raised to potential V4=Vd=Vs3 and a potential e.g. equal to A2=5 V if its input is raised to potential V3.

FIG. 7 shows an example of the timing charts of the potentials applied to inputs E6 (signal S1: timing chart 50) and E7 (connected to the output Sc of comparator circuit 24: timing chart 52) of the shaping circuit, to the outputs Sm1 and Sm2 corresponding to the "shift" and "enable" functions of the shaping circuit (timing charts 54 and 56 respectively) and at output S (signal Vc: timing chart 58) of the "three state" circuit. The timing charts shown in FIG. 7 correspond to tables 2 and 3. These timing charts correspond to an illuminated pixel. The selection time T is divided into three.

Time t1, which starts with the row selection time T, is fixed and determined by signal S1. It is made as short as possible, but sufficiently long to permit the charging of the column capacitance (which corresponds to the capacitance created by a cathode conductor, the facing grid and the inserted insulant) of the considered pixel. Said charging takes place via the column resistance, which corresponds to the resistance of a cathode conductor. For screens of the video screen type t1=1 μs.

For time t1, Vc varies from potential V2 to potential V1. The comparator circuit 24 detects a first passage of Vc through the value Vd. The potential supplied on output Sc of the comparator circuit 24 then passes from value A1 to value A2, e.g. from 0 to 5 V (leading front).

The leading front of the signal supplied on output Sm1 of the "shift" circuit 17 is initiated by the leading front of signal S1. The trailing front of the signal supplied on output Sm1 takes place during time t2. The rising front of the signal supplied on output Sm2 of the "enable" circuit 19 is initiated by the trailing front of signal S1.

Time t2 starts at the end of t1. The cathode conductor is isolated and its control stage is in a high impedance state. The microdots emit electrons, the potential of the considered cathode conductor increasing in a quasi-linear manner from V1 and finally reaches Vc=Vd. The second detection of this potential by comparator circuit 24 ends time t2 (trailing front of the signal supplied on output Sc).

The trailing front of the signal supplied on output Sm2 of "enable" circuit 19 is initiated by the trailing front of the signal supplied on output Sc of comparator 24.

Time t3 starts when t2 is completed and finishes with the row selection time T. Potential Vc varies from Vd to value V2 in accordance with the discharge curve of the column capacitance on the column resistance and is then maintained at this value for the rest of the time t3.

FIG. 7 shows that emission starts during time t1. However, the latter is chosen sufficiently short to ensure that the resulting emission is negligible.

Thus, the emission of electrons by the micro tips mainly takes place during t2. The cathode conductor voltage Vc passes from V1 to Vd, which corresponds to the emission of a charge quantity: q=C×(V1−Vd). C is the value of the column capacitance defined hereinbefore and is substantially identical for each column. In order to have an extinguished pixel, the corresponding cathode conductor is at potential V2 during the corresponding row selection time.

Figure 1:
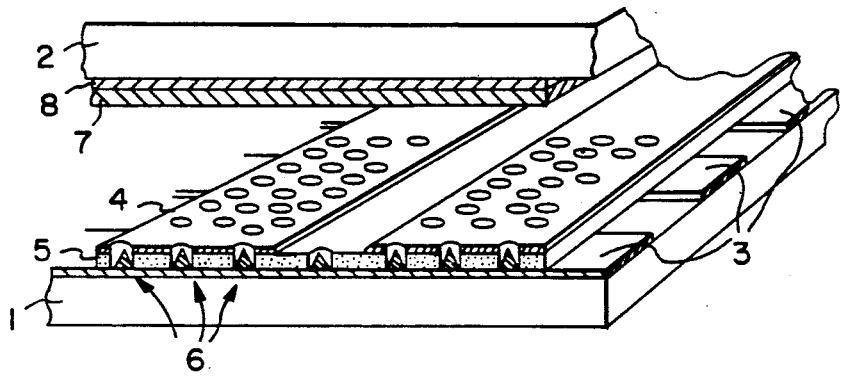
FIG. 1 PRIOR ART
Figure 2:
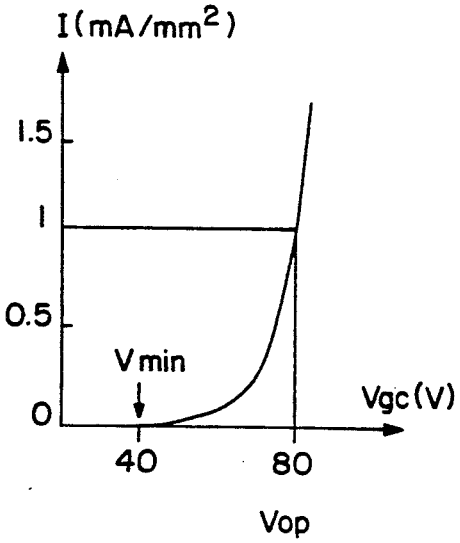
FIG. 2 PRIOR ART
Figure 3:
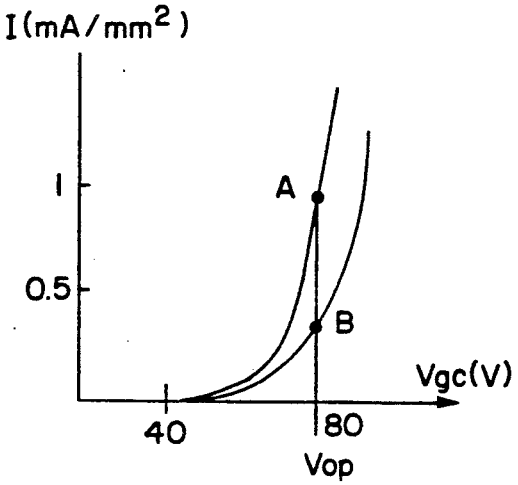
FIG. 3 PRIOR ART

The quantity of charges emitted during the selection time T of a row by an associated illuminated pixel is consequently controlled according to the invention by the choice of the voltage Vd. This control, carried out for a time t2, which can vary between individual cathode conductors, makes it possible to obtain independence of the current fluctuations observed on the anode at the different pixels of the screen (FIG. 3). It is therefore easy to obtain on the one hand a uniform brightness of the screen and on the other to regulate the intensity of said brightness.

We claim:

1. A process for addressing a microtip fluorescent matrix screen for displaying a video image with the aid of pixels able to assume either the "illuminated" state, or the "extinguished" state and for uniformizing to a chosen value of the brightness of the pixels in the "illuminated" state of said screen, said screen having a vacuum cell with a lower support (1) on which are arranged, in the two directions of the matrix, conductor columns (3) (cathode conductors) supporting metallic microtips (6) and, above the columns perforated conductor rows (4) (grids), each intersection of a row i and a column j corresponding to a pixel, the apex of each microtip (6) essentially facing a perforation of the row, the rows and columns being separated by an insulating layer (5) having openings permitting the passage of microtips, a fluorescent material layer (7) facing the grids (4), said layer being placed on a transparent conductive layer (8) (anode), which rests on a transparent upper support (2), the display of a frame of the image taking place by sequentially addressing each grid conductor row i for a selection time T by raising the corresponding grid conductor row i to a constant potential Vg and during the selection time T of said row i and in the following order:

(1) all the cathode conductors (columns) corresponding to a pixel of said row i having to be illuminated are raised to a potential Vc, during a time $t_1$, such that the potential difference Vg−Vc is adequate to "illuminate" the pixels, while ensuring a significant electron emission by the microtips, (2) the cathode conductors are insulated and each of the elementary capacitors formed by the insulating layer (5), the grid and the cathode conductor of each "illuminated" pixel is allowed to discharge on its internal impedance until the spontaneous potential difference variation between its cathode conductor and grid reaches, for each pixel, a level corresponding to the chosen value of the brightness for all the "illuminated" pixels of the screen, (3) after a time $t_2$ when, for each "illuminated" pixel, said condition is fulfilled, action again takes place on its cathode conductor potential Vc by raising it during a time $t_3$ to a value resulting in the extinction of the pixel, the sum $t_1+t_2+t_3$ being equal to the selection time T, $t_1$, being the same for all the pixels and $t_2$ and $t_3$ depending on the pixels current-voltage characteristic.

2. An apparatus for performing a process for addressing a microtip fluorescent matrix screen for displaying a video image with the aid of pixels able to assume either the "illuminated" state, or the "extinguished" state and uniformization to a chosen value of the brightness of the pixels in the "illuminated" state of said screen, said screen having a vacuum cell with a lower support (1) on which are arranged, in the two directions of the matrix, conductor columns (3) (cathode conductors) supporting metallic microtips (6) and, above the columns perforated conductor rows (4) (grids), each intersection of a row i and a column j corresponding to a pixel, the apex of each microtip (6) essentially facing a perforation of the row, the rows and columns being separated by an insulating layer (5) having openings permitting the passage of microtips, a fluorescent material layer (7) facing the grids (4), said layer being placed on a transparent conductive layer (8) (anode), which rests on a transparent upper support (2), the display of a frame of the image or picture taking place by sequentially addressing each grid conductor row for a selection time T within which simultaneous addressing takes place by a data signal of all the pixels of a row during the addressing in order to "illuminate" those pixels of said row which should be illuminated, wherein the addressing of a row i takes place by raising the corresponding grid conductor to a constant potential $V_g$ during the selection time T, all the cathode conductors (columns) corresponding to a pixel of said row i having to be illuminated are raised to a potential Vc, such that the potential difference Vg−Vc is adequate to "illuminate" the pixels, while ensuring a significant electron emission by the microtips, the cathode conductors are insulated and each of the elementary capacitors formed by the insulating layer (5), the grid and the cathode conductor of each "illuminated" pixel is allowed to discharge on its internal impedance until the spontaneous potential difference variation between its cathode conductor and grid reaches, for each pixel, a level corresponding to the chosen value of the brightness for all the "illuminated" pixels of the screen, at the time when, for each "illuminated" pixel, said condition is fulfilled, action again takes place on its cathode conductor potential Vc by raising it to a value bringing about the extinction of the pixel, said apparatus comprising control stages, one control stage for each conductor (3), wherein each control stage comprises:

a three-state circuit (10) capable of assuming any one of three states and having a first input E1 raised to a potential V1 by an external supply (14), an output S supplying the potential Vc, Vc assuming in a recurrent manner a value dependent on the state of the circuit (10) during the selection time T of a row, for the first time t1 starting with the selection time T of each row,, the circuit (10) being in a state 1, Vc is raised to the potential V1 such that the difference Vg−V1 is adequate for "illuminating" the pixel, during a second time t2 dependent on each pixel, the circuit (10) is in a high impedance state 2, Vc varying spontaneously and almost linearly from V1 to a reference potential Vd determined in such a way as to obtain the brightness value chosen for the "illuminated" pixels, during a third time t3 corresponding to T−(t1+t2), the circuit is in a state 3, Vc is raised and maintained at potential V2 until the circuit (10) returns to state 1, a shaping circuit (16) for supplying signals for controlling transitions from one state to another state of the "three state" circuit (10), said signals being supplied by two outputs Sm1 and Sm2 of the shaping circuit (16) respectively connected to two outputs Em1 and Em2 of the "three state" circuit (10), the shaping circuit (16) also having an input E6 connected to the output of a supply (22) common to all the control stages, supplying a periodic signal S1 of duration t1 and period T (selection time of a grid), a comparator circuit (24) having inputs E8, E9 and E10, said input E8 being connected to the output S of the "three state" circuit (10), said input E9 being connected to an output of a supply (26) supplying a potential V3>Vd, and said input E10 being connected to an output of a supply (28) supplying a potential V4≦Vd, V4 being determined according to the chosen value of the screen brightness, the comparator circuit (24) supplying on an output Sc a control signal to an input E7 of the shaping circuit (16), the magnitude of said control signal on output Sc being dependent on whether the magnitude of the signal on input E8 is above or below the reference potential Vd.

3. An apparatus according to claim 2 wherein the circuit (10) of the "three state" type comprises:

two transistors T1 and T2 of the field effect transistor type, which are interconnected by their drains, the output S of the "three state" circuit (10) being connected to the drain-drain connection of the transistors T1 and T2, the source of transistor T1 being connected to input E1 and the source of transistor T2 being connected to the input E2; a conversion stage (30) connected to the inputs E1, E2, Em1, Em2, to the gates of transistors T1 and T2 and to two supplies (18, 20) respectively supplying potentials A1 and A2, said stage (30) ensuring the conversion of potentials A1 and A2 to potentials V2 and V2−Vs2 and potentials A1 and A2 to potentials V1 and V1+Vs1, Vs1 and Vs2 being the threshold voltages of transistors T1 and T1.

4. An apparatus according to claim 2, wherein comparator circuit (24) comprises a resistive circuit (40), a conversion stage (42) and a field effect transistor T3, said resistive circuit being connected to input E9 and connected to the drain of said field effect transistor T3, said field effect transistor T3 being connected by its gate to input E8 and by its source to input E10, the drain-resistive circuit (40) connection being connected to the input of said conversion stage (42), whose output is connected to output Sc, said conversion stage (42) also being connected to two supplies respectively supplying potentials A1, A2, said conversion stage (42) ensuring the translation of potentials V3 and V4 to potentials A2 and A1.

5. An apparatus according to claim 2, wherein the shaping circuit (16) comprises means (17) for performing a "shift" function and means (19) for performing an "enable" function respectively supplying shaping signals on outputs Sm1 and Sm2.

* * * * *